US010655847B2

(12) United States Patent
Hutcheson

(10) Patent No.: US 10,655,847 B2
(45) Date of Patent: May 19, 2020

(54) OXY/ACETYLENE CUTTING TIP CLEANER

(71) Applicant: David Hutcheson, Whittier, CA (US)

(72) Inventor: David Hutcheson, Whittier, CA (US)

( * ) Notice: Subject to any disclaimer, the term of this patent is extended or adjusted under 35 U.S.C. 154(b) by 596 days.

(21) Appl. No.: 15/432,325

(22) Filed: Feb. 14, 2017

(65) Prior Publication Data

US 2017/0321892 A1 Nov. 9, 2017

Related U.S. Application Data

(60) Provisional application No. 62/333,777, filed on May 9, 2016.

(51) Int. Cl.

| | |
|---|---|
| ***F23D 14/50*** | (2006.01) |
| ***B08B 9/02*** | (2006.01) |
| ***B08B 9/027*** | (2006.01) |
| ***B08B 9/00*** | (2006.01) |
| ***F23D 14/42*** | (2006.01) |
| ***B08B 1/00*** | (2006.01) |
| *B05B 15/522* | (2018.01) |

(52) U.S. Cl.

CPC ..... *F23D 14/50* (2013.01); *B08B 1/005* (2013.01); *B08B 9/00* (2013.01); *B08B 9/021* (2013.01); *F23D 14/42* (2013.01); *B05B 15/5223* (2018.02)

(58) Field of Classification Search

CPC ..... B08B 9/0436; B08B 9/0437; B08B 1/005; B08B 9/00; B08B 9/021; B05B 15/5223; F23D 14/42; F23D 14/50

USPC ..... 15/104.05, 104.001, 104.03; 401/31

See application file for complete search history.

(56) References Cited

U.S. PATENT DOCUMENTS

| | | | | |
|---|---|---|---|---|
| 3,315,295 | A * | 4/1967 | Jeter, Jr. | F23D 14/50 15/105 |
| 4,202,570 | A * | 5/1980 | Riggins | E05B 65/087 292/60 |
| 4,327,790 | A * | 5/1982 | Stevens | B25B 23/18 81/177.4 |
| 4,595,136 | A * | 6/1986 | Cooper | B23K 5/22 15/104.05 |
| 5,339,485 | A * | 8/1994 | Ingram | B08B 1/00 15/104.001 |

* cited by examiner

*Primary Examiner* — Marc Carlson
(74) *Attorney, Agent, or Firm* — Edwin Tarver

(57) ABSTRACT

An oxy-acetylene cutting torch tip cleaner includes an elongated body portion with at least one actuator and at least one associated housing bore for storing a cleaning pin. Each cleaning pin is coupled to an actuator movable from a first position with the cleaning pin contained in the housing bore to a second position with the cleaning pin extending from the housing bore, for abrading and cleaning the cutting torch tip. Each actuator, coupled to its cleaning pin with a slider, is biased to the first position and a lock engages each actuator in the second position such that when the lock is disengaged from the actuator at the second position with the cleaning tip extended from the body, the actuator automatically returns to the first position thereby retracting the cleaning pin back into the housing bore.

7 Claims, 6 Drawing Sheets

OXY/ACETYLENE CUTTING TIP CLEANER

This application claims the benefit of the priority filing date of provisional application No. 62/333,777, filed on May 9, 2016, which is incorporated by reference in its entirety.

BACKGROUND

Field of the Invention

The present invention generally relates to oxy/acetylene cutting torch cleaners. More specifically, the present invention relates to a cleaner for the preheating bores and central cutting bore of an oxy/acetylene cutting torch tip.

Related Art

Oxy/Acetylene torches use tips, typically copper, having several preheating bores around a central cutting bore. Acetylene gas or a gas/oxygen mixture travels through the preheating bores and is ignited to heat a work unit of metal. Once the work unit is heated, activating an oxygen-blast trigger on the torch sends oxygen through the cutting bore under high velocity. The oxygen reacts with the high temperature metal, producing additional heat and melting a cut in the work unit. Importantly the flame shape emanating from the tip affects the quality of any particular cut. To produce clean cuts, a symmetric flame is required. Yet in the cutting process, and including over the course of repeated cuts, debris and other molten contaminant material occasionally reaches the cutting bore and/or preheating bores, partially or totally occluding them. In particular, a partially occluded cutting bore results in a disfigured flame and a poor cut.

To solve that problem, oxy/acetylene tip cleaners have been developed. These cleaners typically consist of long metal cleaning pins, complimentary in diameter to a cutting bore or the preheating bores. The cleaning pin is abraded or otherwise textured along its length to catch debris residing in (and adjacent to the entrance of) a bore. Sliding the cleaning pin in and out of the cutting bore or preheating bores cleans them in a manner similar to a pipe-cleaner. Tip cleaners currently available in the art include a series of differently sized pins. The cleaning pins are looped at one end and stored loosely on a dowel in a folding case.

To use a currently available tip cleaner, a user must unfold the case, select an appropriately sized cleaning pin, and insert the cleaning pin into a cutting and/or preheating bore needing cleaning. This action is disfavored because the cleaning pins are small and loosely held on a dowel in the folding case. A user must remove protective hand gear, fumble with the case, and attempt to find the appropriate cleaning pin through trial and error, much like selecting an appropriate key for a lock. In addition to the frustration of finding the appropriate cleaning pin, this process risks burn injury from the cutting tip as the user inserts a cleaning pin. Also, due to the small size of the cleaning pins and case, manipulating a cleaning pin into a cutting and/or preheating bore is difficult, particularly when clogged with debris.

Hence, what is needed is a cleaner for oxy/acetylene cutting torch tips, and other attachments such as rosebud heaters and welding tips, that allows users to easily and effectively clean cutting and preheating bores without the limitations of existing techniques.

SUMMARY

An apparatus is disclosed for effectively cleaning oxy-acetylene cutting torch tips by abrasion with appropriately sized cleaning pins. The apparatus includes a body portion, which is elongated along an axis. The body portion includes an actuator, such as a thumb screw for example, and a housing bore or pin housing for storing a cleaning pin, with the housing bore and the cleaning pin oriented parallel to the axis. The cleaning pin is coupled to the actuator, and movable in tandem with the actuator from a first position, wherein the cleaning pin is contained within the housing bore, to a second position wherein the cleaning pin extends from the housing bore and body portion for engaging and abrading the cutting torch tip to remove debris. The actuator, and thus the cleaning pin, are biased to the first position and a lock is provided at the second position, configured to engage the actuator when the actuator is brought to the second position. Therefore, disengaging the lock with the actuator at the second position with the cleaning tip extended from the body, causes the actuator to return to the first position thereby retracting the cleaning pin into the housing bore.

Preferably, the apparatus includes a plurality of actuators disposed around the body, with a corresponding plurality of housing bores and cleaning pins located in them. In use, the actuator travels along a slider slot on the body, with the slot also oriented parallel to the axis. In the preferred instance of multiple actuators, each actuator preferably travels along an individual slot on the body. In one embodiment, the slot includes a lock pocket freely accessible from the slot at the second position for accepting the actuator. In a further embodiment, the lock pocket may be formed as a catch portion of the slot for retaining the actuator.

In preferred embodiments, the actuators each include a cylindrical slider engaged by a removable thumb screw actuator, conveniently placed so that a user may operate the thumb screw using the user's thumb. The cylindrical slider travels in a slider bore, preferably in open communication with the housing bore, and the cylindrical slider in the slider bore is coupled to the cleaning pin. In the preferred instance of multiple actuators, each actuator preferably corresponds with an individual cylindrical slider, removable thumb screw, and slider bore. In a further embodiment, a center bore extends through the body. The center bore is preferably sized for holding additional cleaning pins, and in the event of multiple cylindrical sliders, is surrounded by the slider bores. An end cap is preferably provided, and is removably affixed to the body to cover the center bore and the slider bore or bores, thus, the end cap is ideally located opposite the housing bore (or bores) along the axis.

In one alternative embodiment, the apparatus for cleaning oxy-acetylene cutting torch tips may be characterized as an elongated body having one or more slider bores and one or more opposing housing bores, each containing a cleaning pin. An actuator is configured to slide along the body from a first position to a second position corresponding to each set of slider bores, housing bores and cleaning pins. A lock associated with each actuator is configured to releasably lock its associated actuator at the second position, and each cleaning pin is coupled to an actuator such that the cleaning pin moves in tandem with the actuator from the first position with the cleaning pin contained in the housing bore, to the second, optionally locked position with the cleaning pin extending from the body. The actuator or actuators are biased to the first position, such that releasing a lock causes its associated cleaning pin to retract into the cleaning pin's housing bore.

In another alternative embodiment, the apparatus for cleaning oxy-acetylene cutting torch tips is characterized as having an elongated body with a slider bore and an opposing housing bore containing a cleaning pin. A slider is coupled to the cleaning pin, with the slider movable inside the slider bore from a first position, with the cleaning pin contained in the housing bore, to a second position with the cleaning pin extending from the elongated body. An actuator is coupled to the slider through a slider slot, and a lock is configured to releasably lock the actuator in the second position with the actuator biased to the first position, so that releasing the lock causes the cleaning pin to retract into the housing bore.

DETAILED DESCRIPTION

The following description is presented to enable any person skilled in the art to make and use the invention, and is provided in the context of a particular application and its requirements. Various modifications to the disclosed embodiments should be readily apparent to those skilled in the art, and the general principles defined herein may be applied to various other embodiments and applications without departing from the spirit and scope of the present invention. For example, not only oxy/acetylene cutting tips, but other tips, typically copper, such as welding tips (including rosebud-type tips) are contemplated. Thus, the present invention is not limited to the embodiments shown, but is to be accorded the widest scope consistent with the principles and features disclosed herein.

Figure 1:
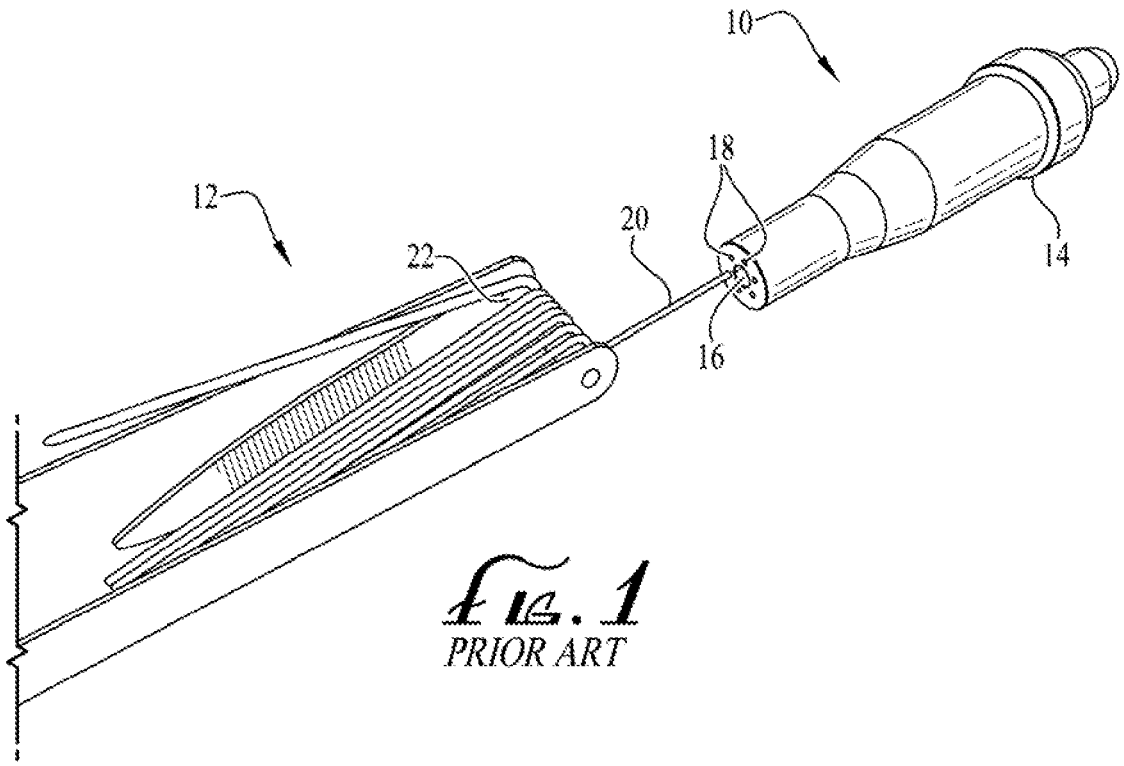
FIG. 1 PRIOR ART
FIG. 1 illustrates a prior art tip cleaning kit cleaning an oxy/acetylene cutting tip.

Referring to FIG. 1, an oxy/acetylene cutting tip (tip) 10 and prior art tip cleaning kit (kit) 12 are shown. The tip 10 is of substantially solid copper construction, and includes a seat 14 for capturing the tip 10 within an oxy/acetylene torch (not shown). The tip 10 includes a cutting bore or hole 16, surrounded by a series of smaller pre-heating bores or holes 18. During cutting, molten metal and other debris occasionally occlude one or more of the preheating holes 18, or occlude the cutting hole 16 which deforms the shape of a cutting flame (not shown) and resulting in an uneven or otherwise undesired cut. To clear an occluded cutting hole 16, a user must open the kit 12, and select an appropriately sized tip cleaning abrasive pin 20 from among several prior art cleaning pins 20 installed in the kit 12. Since the prior art cleaning pins 20 are loosely held on a spanning dowel 22, selecting the appropriate prior art cleaning pin 20 is difficult, requiring a user to turn off the torch, remove any protective hand covering, and fumble with the kit 12 until the proper size prior art cleaning pin 20 is found. This process is time consuming, cumbersome, and risks injury from burning by the tip 10, which remains hot long after the torch is extinguished.

Figure 2:
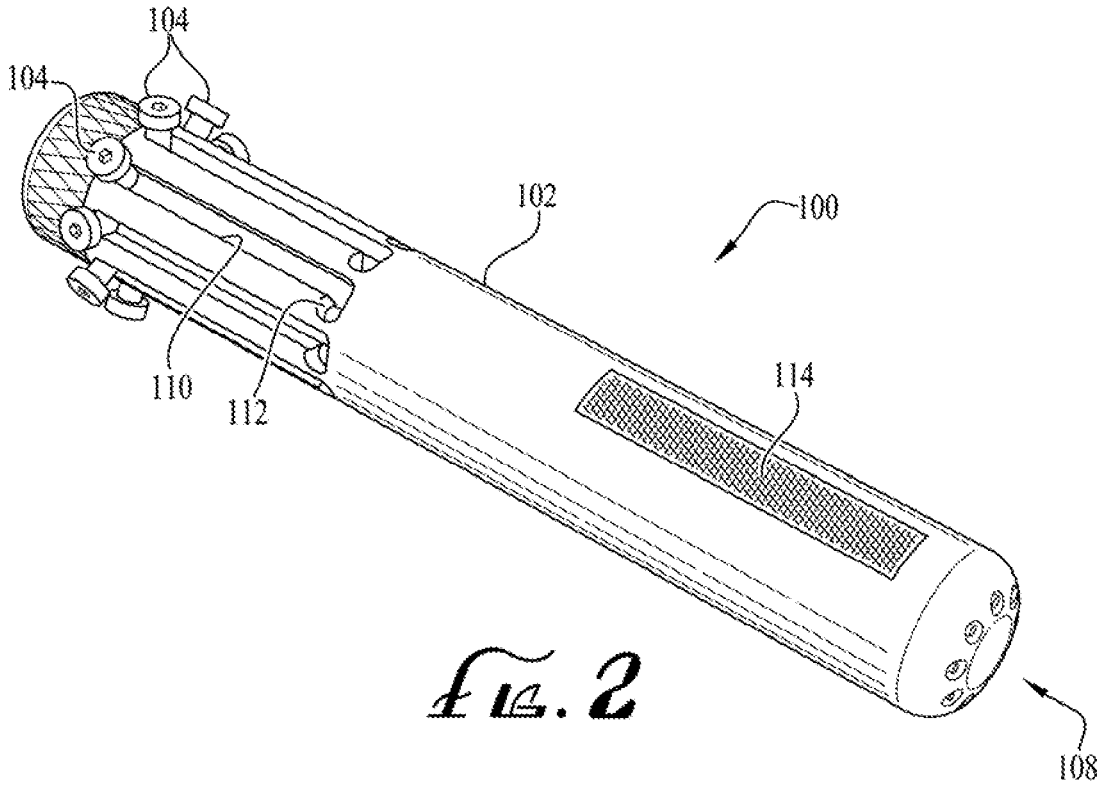
FIG. 2 illustrates a perspective view of an improved cutting tip cleaning apparatus.

Referring to FIG. 2, an improved tip cleaner 100 has a substantially cylindrical body 102, including a series of thumb screws 104. Each thumb screw 104 is associated with an individual cleaning pin 106 (FIG. 3) in one of several pin housings 108. The tip cleaner 100 preferably includes cleaning pins 106 of varying sizes according to preference. Each of the thumb screws 104 slides along a slider slot 110, causing its associated cleaning pin 106 to extend out of its associated pin housing 108. Each slider slot 110 terminates in a lock pocket 112 allowing a user to lock a thumb screw 104 in the lock pocket 112, thereby locking its associated cleaning pin 106 in a position extended from the body 102 for cleaning a tip 10. The tip cleaner 100 also preferably includes a file 114 to be used in combination with a cleaning pin 106 for burnishing a tip 10 after cleaning a cutting hole 16 or preheating hole 18.

Figure 3:
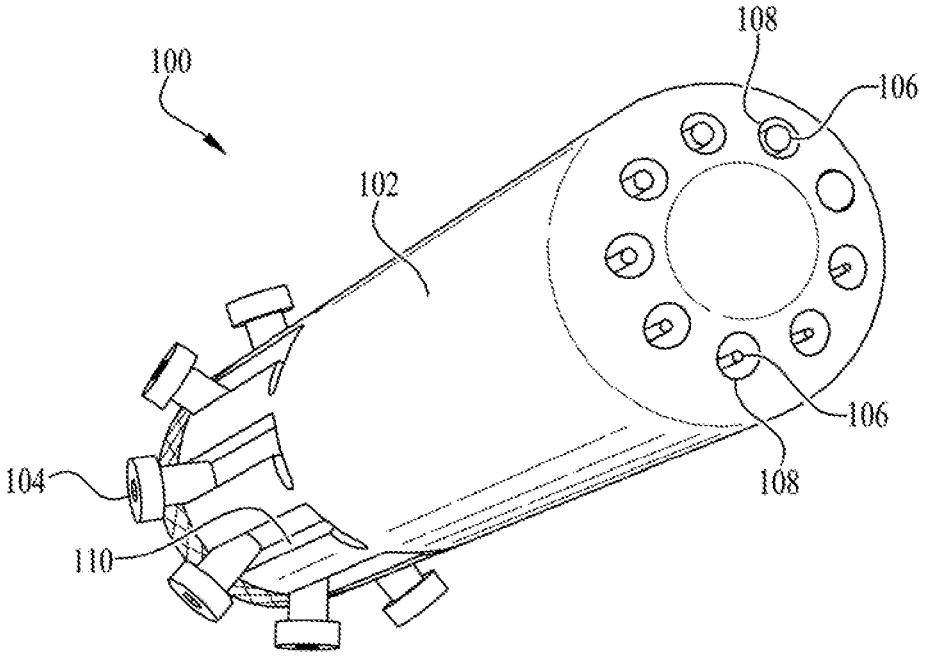
FIG. 3 illustrates a perspective view of a front portion of the apparatus with cleaning pins housed therein.

Referring to FIG. 3, the pin housings 108 are shown, with each pin housing 108 bearing a different size cleaning pin 106. In a preferred embodiment, a variety of sizes of cleaning pins 106 are selected according to one or more particular sizes of tip 10 used in a cutting project. Since the preheating bores 18 on a tip 10 are typically very small, inserting a cleaning pin 106 can be difficult. Occasionally cleaning pins 106 are bent in the process of inserting them into a cutting hole 16 or preheating hole 18. For this reason, two or more cleaning pins 106 of the same size may be housed into the tip cleaner 100, according to preference, in lieu of cleaning pins 106 having all difference sizes.

Figure 4:
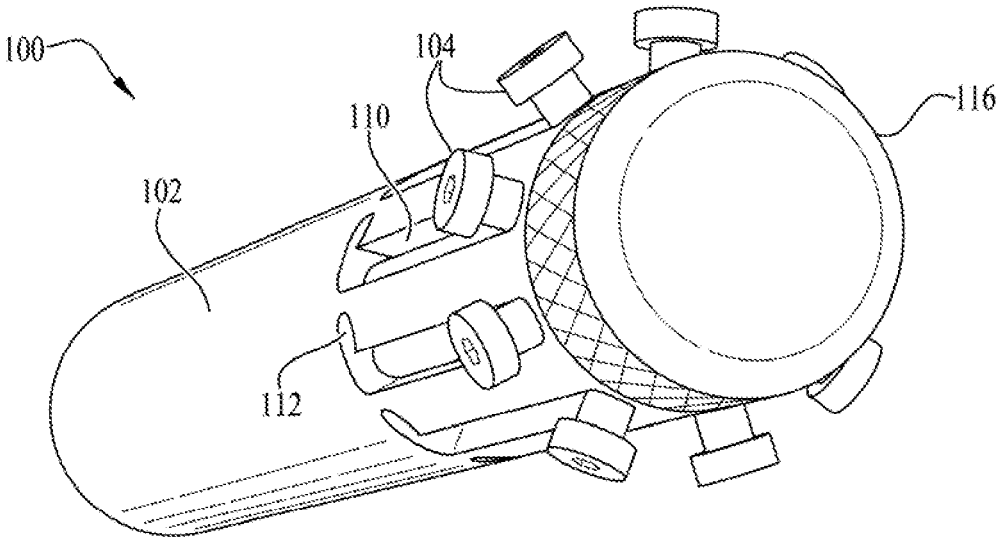
FIG. 4 illustrates a perspective view of a rear portion of the apparatus.

Referring to FIG. 4, opposite the pin housings 108 on the body 102, the tip cleaner 100 has an end cap 116. The end cap 116 is preferably slip resistant, thereby allowing a user to easily rotate the end cap 116 to gain access to the interior of the tip cleaner 100, which includes a center bore 120 (FIG. 6) that holds extra cleaning pins 106, and other items. In one preferred embodiment, the thumb screws 104 preferably comprise threaded thumb screws 104 that can each be loosened and removed according to preference.

Figure 5:
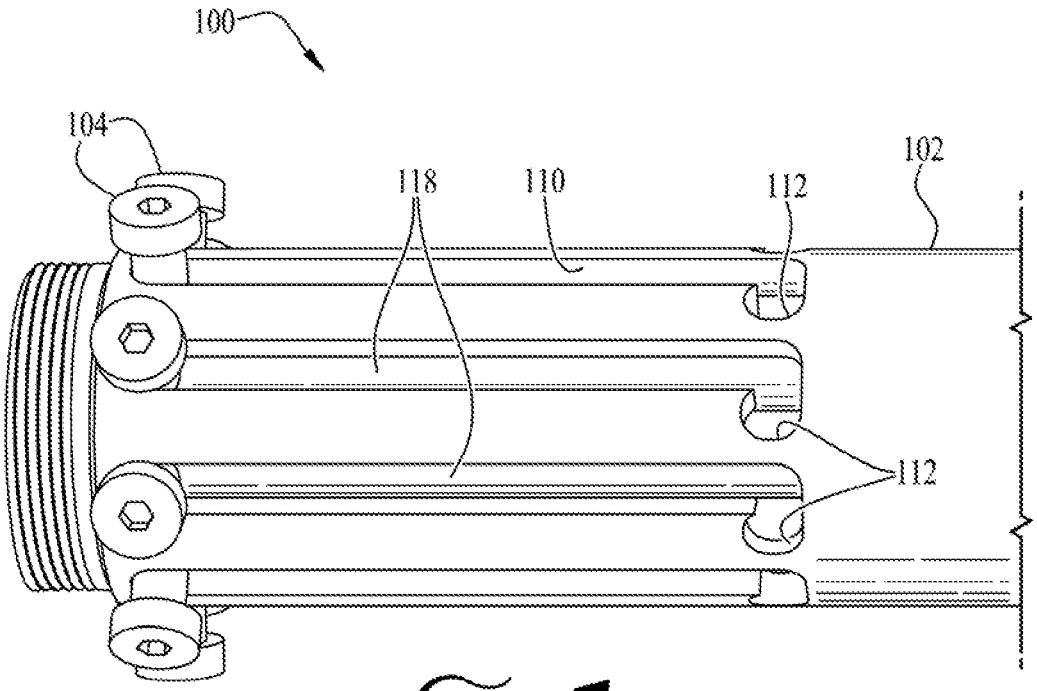
FIG. 5 illustrates a side view of the rear portion of the apparatus with an end cap removed.
Figure 6:
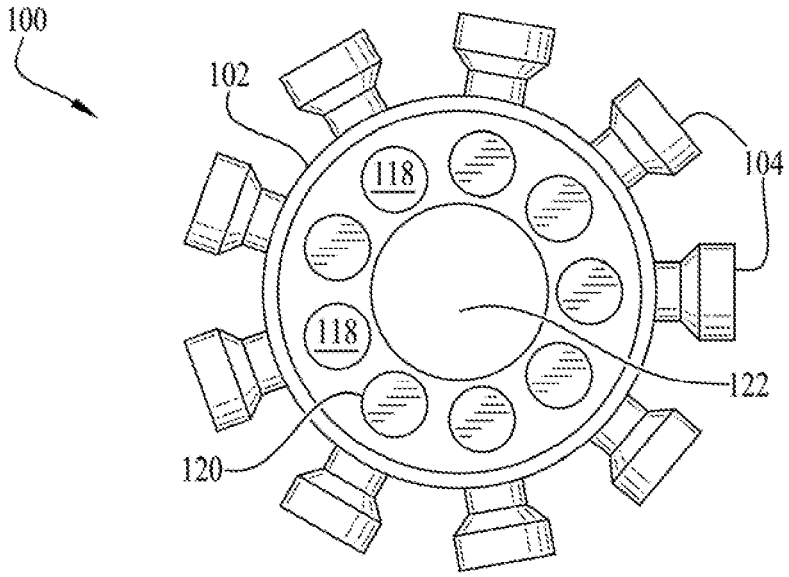
FIG. 6 illustrates a rear view of the apparatus showing a storage center bore and a series of slider bores.

Referring to FIG. 5, each of the thumb screws 104 engages a slider 118 that travels through a slider bore 120 (FIG. 6). As a slider 118 travels through its associated slider bore 120, the thumb screw 104 travels along its associated slider slot 110. When a thumb screw 104 engages a lock pocket 112, the slider 118 associated with that thumb screw 104 is held in place, thus holding a cleaning pin 106 in a position extending from the body 102. All sliders 118 are able to turn freely in their respective slider bores 120, enabling the thumb screws 104 to rotate into their respective lock pockets 112.

Referring to FIG. 6, each thumb screw 104 is affixed to a slider 118, and each slider 118 is installed in a slider bore 120 running lengthwise through the body 102. The slider bores 120 surround the center bore 122 which is primarily used for storing extra cleaning pins 106 and tools shown in FIG. 7. By removing a thumb screw 104, its associated slider 118 may be removed from the body 102 for replacing one cleaning pin 106 with a different cleaning pin 106.

Figure 7:
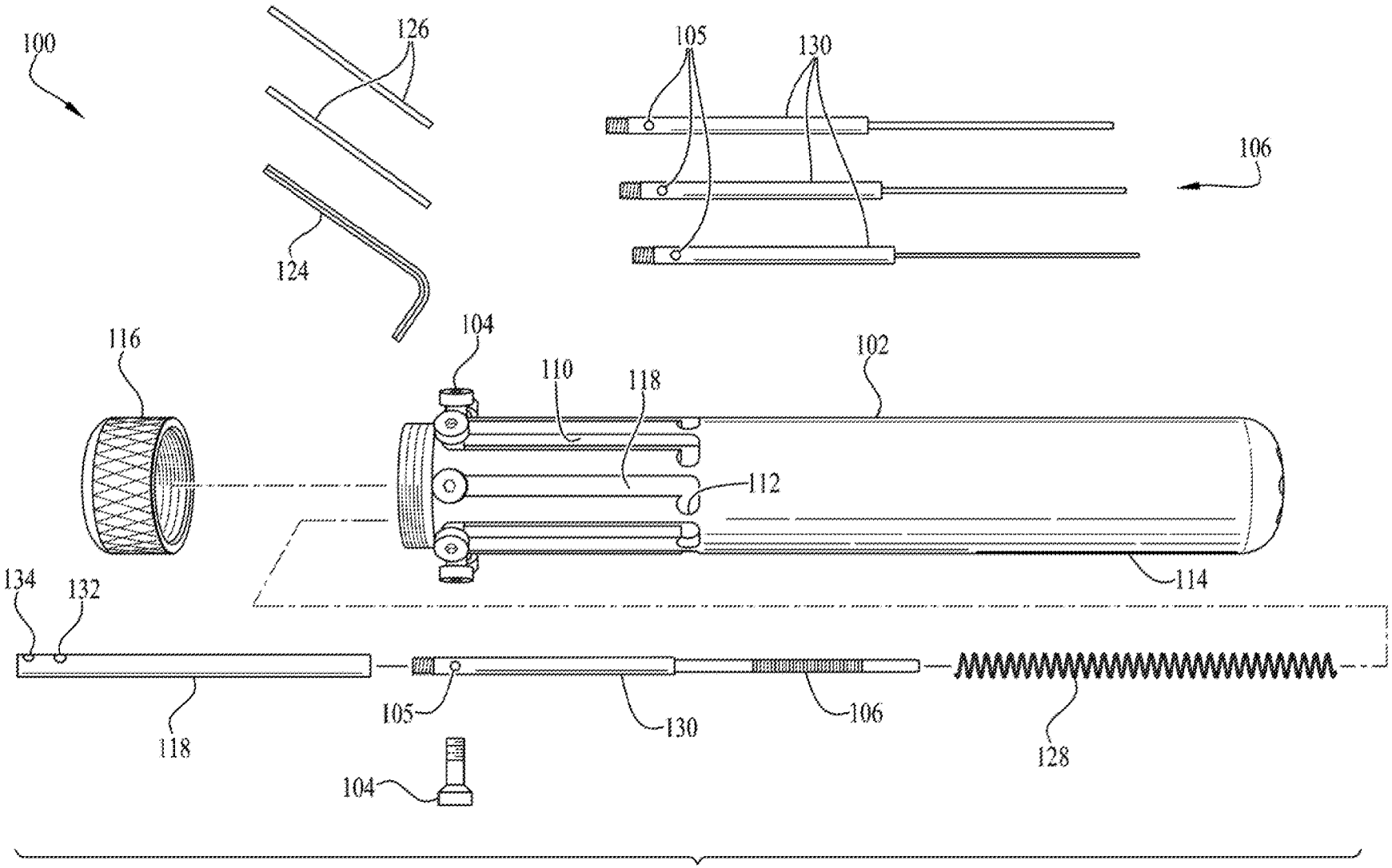
FIG. 7 illustrates an exploded view of the apparatus, partially disassembled, including extra components to be held in the center bore.

Referring to FIG. 7, the tip cleaner 100 is shown with the end cap 116 separated from the body 102, and extra cleaning pins 106 with their adapters 130, a hex wrench 124 and a set of spanner pins 126 removed. Preferably all of the adapters 130 are marked with indicia (not shown) corresponding to sizing tables for conventional oxy/acetylene cutting torch tips. Although frequent users can typically select an appropriately sized cleaning pin 106 for a particular cutting torch tip 10 by sight, the indicia provide an easy and quick reference when selecting and installing an appropriate cleaning pin 106 (and adapter 130) for use in the tip cleaner 100.

Still referring to FIG. 7, the hex wrench 124 and spanner pins 126 are used for removing and installing different sizes of cleaning pins 106 in the tip cleaner 100 according to preference. Each of the differently sized cleaning pins 106 is preferably associated with a uniformly sized tip adapter 130 for easy interchangeable threaded engagement with any of the sliders 118, which are also preferably of uniform size. In order to separate, engage and tighten a slider 118 against a selected tip adapter 130 (and thus, a particular size of cleaning pin 106), a tip adapter bore 105 is formed in each of the tip adapters 130. The spanner pins 126, preferably stored in the center bore 122 (FIG. 6) along with the hex wrench, are removed and inserted into a selected tip adapter bore 105, and a spanner pin bore 134 located on an associated slider 118. The spanner pins 126 allow hand tightening of the tip adapter 130 against the slider 118 with sufficient torque, such that the slider 118 and tip adapter 130 (and thus, cleaning pin 106) will not dislodge during normal use.

Also shown in this figure is an exploded view of a spring 128, cleaning pin 106, tip adapter 130 and slider 118, all of which, when coupled together, are inserted into a slider bore 120. A thumb screw 104 engages a threaded bore 132 on the slider 118 opposite the tip adapter 130, and travels in a slider slot 110 associated with a slider bore 120 holding the slider 118, for extending the cleaning pin 106 from the body 102 to clean a tip 10, and for allowing the cleaning pin 106 to retract back into the body 102, biased to the retracted position by the spring 128, when the thumb screw 104 is disengaged from the lock pocket 112 on the slider slot 110 associated with the extended position.

Figure 8:
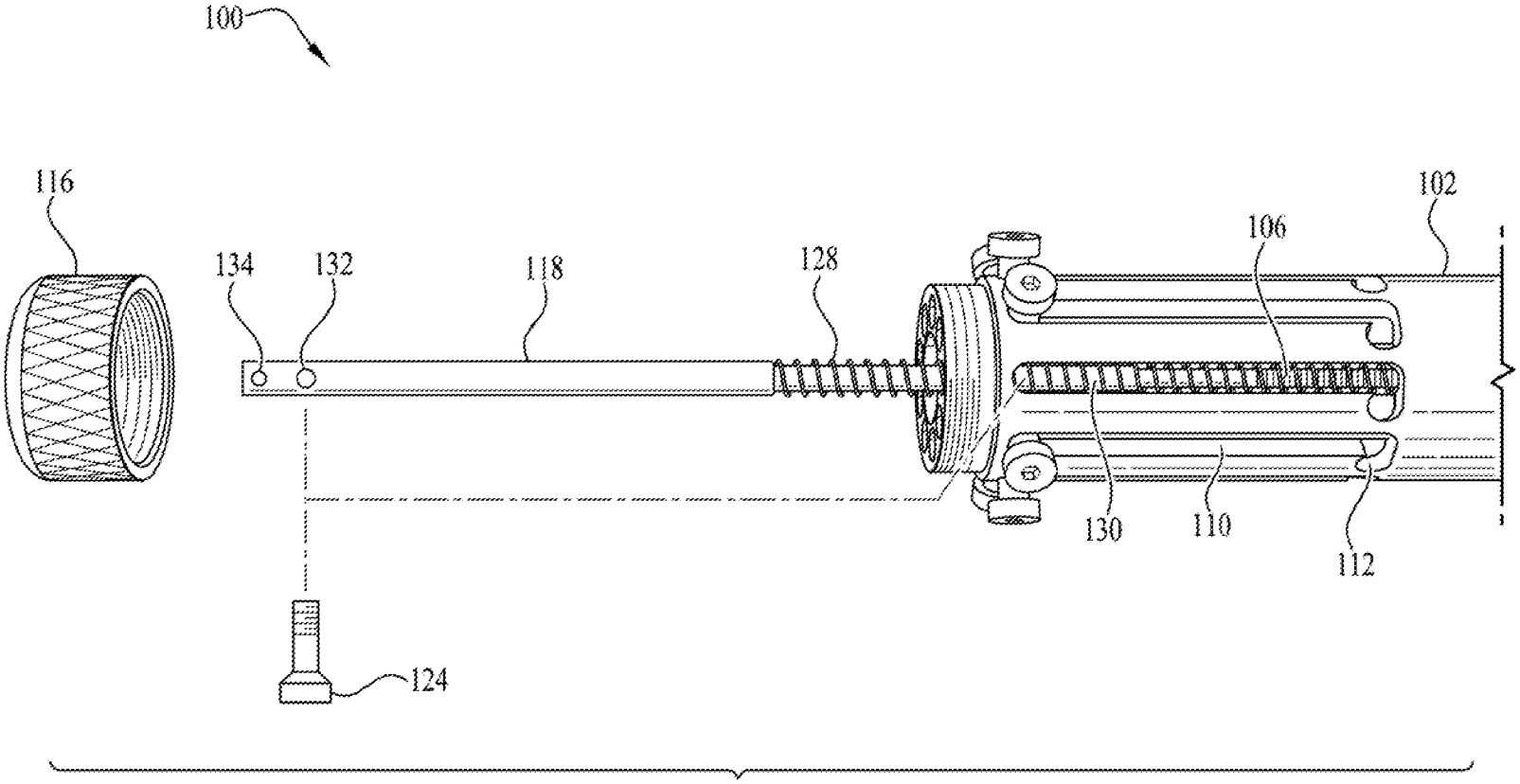
FIG. 8 illustrates an exploded view of the rear portion the apparatus in the initial stages of cleaning pin installation.

Referring to FIG. 8, the tip cleaner 100 is shown in an initial stage of removing a cleaning pin 106. With the end cap 116 removed, a user employs the hex wrench 124 to loosen a thumb screw 104, preferably unscrewing the thumb screw 104 by hand thereafter, until it disengages a slider 118. The spring 128 causes the slider 118, and its associated tip adapter 130 and cleaning pin 106 to travel out of the slider bore 120, thereby allowing a user to remove the cleaning pin 106 and tip adapter 130 and install a different cleaning pin 106 and tip adapter 130 in the slider bore 120.

Figure 9:
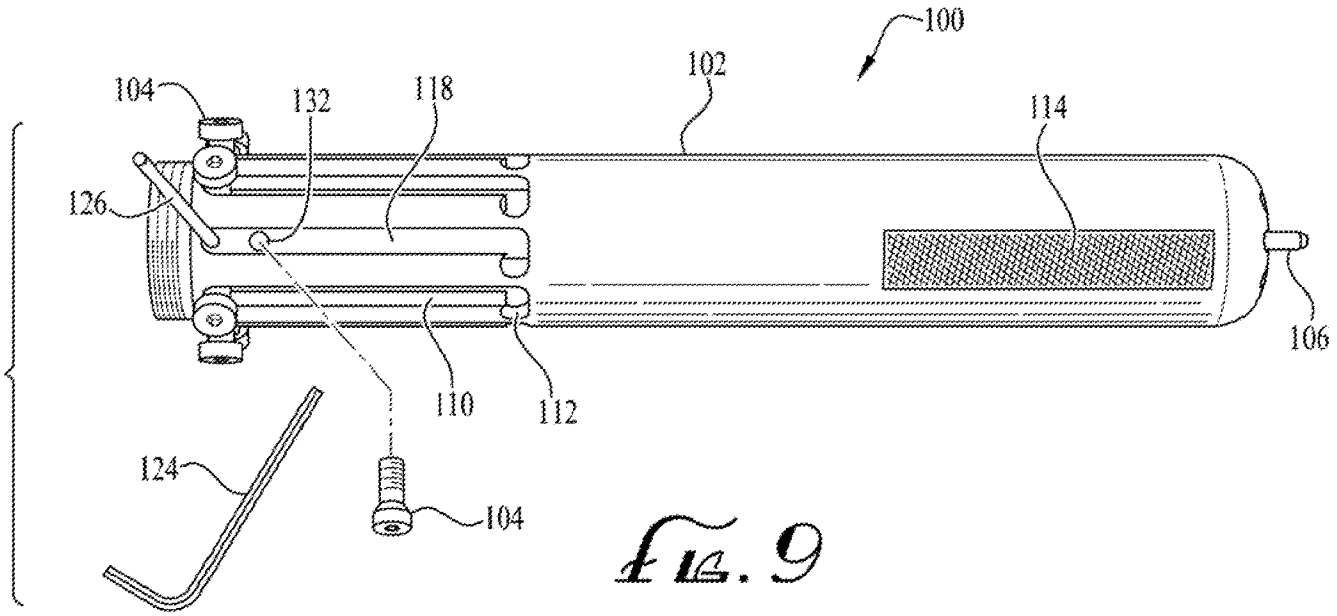
FIG. 9 illustrates an exploded view of the apparatus in the final stages of installing a cleaning pin.

Referring to FIG. 9, installing a spring 128, cleaning pin 106, tip adapter 130 and slider 118 involves the use of the spanner pins 126 due to the biasing action of the spring 128 on a slider 118. In order to complete installation, a spring 128 is installed over a cleaning pin 106 and tip adapter 130, with the tip adapter affixed to a slider 118, and inserted into a slider bore 120. The slider 118 is pushed into the slider bore preferably using a spanner pin 126 by either pushing on the slider 118 in the slider bore 120, or anchoring the spanner pin 126 in the threaded bore 132 used for anchoring a thumb screw 104 to the slider 118. Using the spanner pin 126 to urge the slider 118 forward, a spanner pin bore 134 is exposed in the slider slot 110, and a second spanner pin 126 may be inserted therein. With the spanner pin 126 anchored in the spanner pin bore 134, the threaded bore 132 is exposed in the slider slot 110, allowing a user to install a thumb screw 104 in the threaded bore 132. Thereafter, the spanner pin 126 may be removed from the spanner pin bore 134, and the thumb screw 104 prevents the slider 118 from traveling out of the slider bore. The hex wrench 124, spanner pin(s) 126 and any extra cleaning pins 106 (and their associated tip adapters 130) may be inserted into the center bore 122 before replacing the end cap 116.

Figure 10:
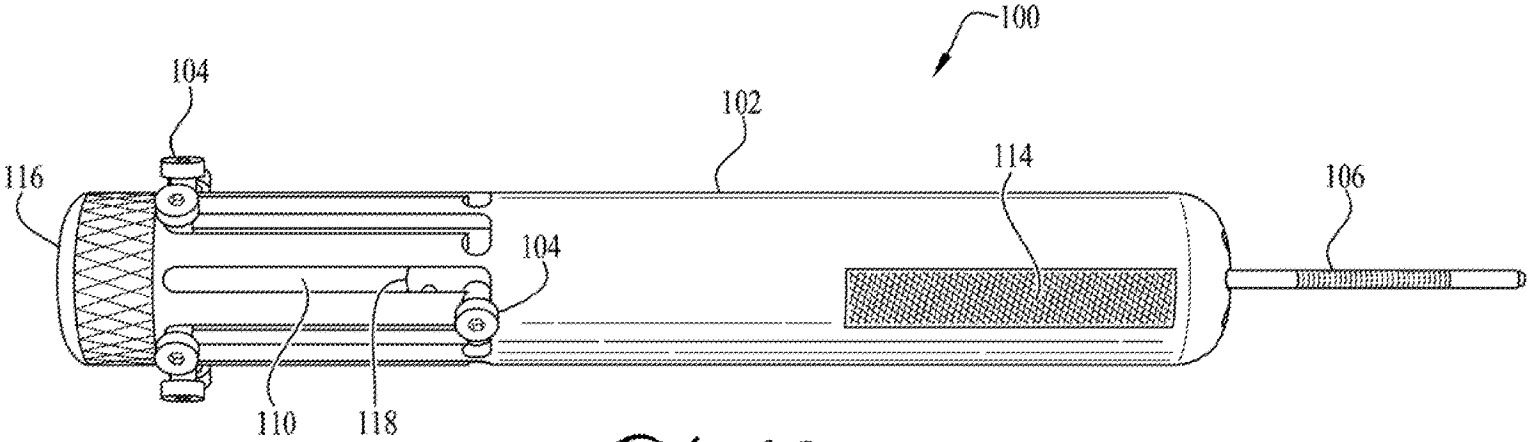
FIG. 10 illustrates the apparatus with a cleaning pin extended, ready for cleaning insertion into a cutting tip.

Referring to FIG. 10, with the new cleaning pin 106 installed in the tip cleaner 100, a thumb screw 104 associated with the newly installed cleaning pin 106 may be urged along its respective slider slot 110, against resisting force from the spring 128, until the thumb screw 104 encounters the lock pocket 112 and is rotated into a locked position. In the locked position, the cleaning pin 106 is locked in place extending from the body 102 and may be inserted into an occluded or otherwise malfunctioning cutting hole 16 or preheating hole 18 of a tip 10 to clean out undesirable debris located therein.

The structure of the tip cleaner 100 having been shown and described, its method of use will now be discussed.

During an oxy/acetylene torch cutting operation, molten metal or other debris will occasionally enter or otherwise block one or more cutting holes 16 and/or preheating holes 18 of a cutting tip 10, causing alterations in flame shape, and resulting in a less clean or otherwise undesirable cut. When that happens, a user extinguishes the torch and procures a tip cleaner 100 which may be stored in a pocket or similarly easy to reach location. Due to the size and weight of the tip cleaner 100 as opposed to a small prior art kit 12, the tip cleaner 100 may be used with gloves on, which helps avoid burns or other injury.

With the tip cleaner 100 in one hand, the user uses a thumb to slide an appropriate thumb screw 104 along its associated slider slot 110, ultimately rotating the thumb screw 104 into its associated lock pocket 112. As the thumb screw 104 travels along the slider slot 110, its corresponding slider 118 travels along its associated slider bore 120, against resisting pressure from its associated spring 128, urging its associated tip adapter 130 and cleaning pin 106 forward. The cleaning pin 106 extends from the body and is locked in a fully extended position when the thumb screw 104 is rotated into the lock pocket 112.

With the cleaning pin 106 in an extended and locked position, the cleaning pin 106 is inserted into an occluded or otherwise malfunctioning cutting hole 16 or preheating hole 18. As the cleaning pin 106 is inserted and removed from the cutting hole 16 or preheating hole 18, its rough surface scours the cutting hole 16 or preheating hole 18 clean. The file 114 on the surface of the body 102 may also be employed during this process to aid in cleaning the tip 10. Once the cutting hole 16 or preheating hole 18 is properly cleaned, the user rotates the thumb screw 104, still using one hand, out of the lock pocket 112, and releases the thumb screw 104. Upon releasing the thumb screw 104, the spring 128 urges the slider 118 in a reverse direction through its associated slider bore 120, thereby retracting the cleaning pin 106 back into its associated pin housing 108. The slider slot 110 is preferably sized such that when the spring 128 brings the thumb screw 104 to the terminal end of the slider slot 110, the cleaning pin 106 is brought within the body 102, and stored in its respective pin housing 108. Thereafter, the tip cleaner 100 can be replaced in the user's pocket.

On occasion, a cleaning pin 106 will be bent or otherwise damaged during a cleaning operation, or a user will employ a differently sized cutting tip 10, requiring a different size of cleaning pin 106. In such instances, the user may easily exchange one cleaning pin 106 installed in the tip cleaner 100 with another, differently sized cleaning pin 106. This is accomplished by first removing the end cap 116 from the body 102, and removing the hex wrench 124, spanner pin(s) 126 and uninstalled cleaning pins 106 (and the associated tip adapters 130 affixed thereto).

To remove an undesired installed cleaning pin 106, the hex wrench 124 is inserted into the thumb screw 104 associated with the cleaning pin 106 and rotated to loosen the thumb screw. The thumb screw 104 may be further loosened by hand until it disengages its associated slider 118. Once the thumb screw 104 disengages the slider 118, the spring 128 will urge the slider out from its associated slider bore 120 and away from the body 102. The user can then pull the slider 118, and the tip adapter 130, cleaning pin 106 and spring 128 associated with it fully out of the body 102, and disconnect the tip adapter 130 and cleaning pin 106 from the slider 118.

A new appropriately sized cleaning pin 106 and its associated tip adapter 130 are then selected from among those formerly contained in the center bore 122. Alternatively, an appropriately sized cleaning pin 106 (and tip adapter 130) may be obtained from another preferred location. The cleaning pin 106 and tip adapter 130 are attached to the slider 118 and the spring 128 installed over them. The cleaning pin 106, tip adapter 130, slider 118 and spring 128 are inserted into the appropriate slider bore 120, and pushed forward using a spanner pin 126 until the spanner pin bore 134 is exposed by the slider slot 110. Another spanner pin 126 is inserted into the spanner pin bore 134 to hold the slider 118 in position, and its associated thumb screw 104 is rotated in the threaded bore 132 to affix it to the slider 118. The thumb screw 104 is tightened in position with the hex wrench 124 to prevent it from inadvertent loosening.

With the thumb screw 104 securely in position, the spanner pin 126 can be removed from the spanner pin bore 134, thereby allowing the spring to drive the cleaning pin 106 into its fully retracted resting position in its pin housing 108. The hex wrench 124, spanner pin(s) 126, and the removed cleaning pin 106 (and tip adapter 130) are then inserted into the center bore 122 where they are housed until needed, and secured therein by replacing the end cap 116. The tip cleaner 100 is then ready for continued use as desired.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Although a very narrow claim is presented herein, it should be recognized the scope of this invention is much broader than presented by the claim. It is intended that broader claims will be submitted in an application that claims the benefit of priority from this application.

What is claimed is:

1. An apparatus for cleaning oxy-acetylene cutting and welding_torch tips and miscellaneous precision orifices, the apparatus comprising:

an elongated body having a slider bore and an opposing housing bore containing a cleaning pin;

an actuator configured to slide along the body from a first position to a second position;

a lock configured to releasably lock the actuator in the second position;

the cleaning pin coupled to the actuator such that the cleaning pin moves in tandem with the actuator from the first position, wherein the cleaning pin is contained in the housing bore, to the second position wherein the cleaning pin extends from the body;

the actuator biased to the first position, wherein the cleaning pin is retracted into the housing bore with the lock released; and a file disposed on the elongated body between the housing bore and the actuator.

2. The apparatus of claim 1 comprising a plurality of actuators, housing bores and cleaning pins.

3. The apparatus of claim 1 wherein the lock comprises a lock pocket for holding the actuator in the second position.

4. The apparatus of claim 1 further comprising a cylindrical slider coupled to the actuator and the cleaning pin.

5. The apparatus of claim 4 wherein the cylindrical slider travels through a slider bore, with the slider bore in open communication with the housing bore.

6. The apparatus of claim 5 further comprising an end cap removably affixed to the body and covering the slider bore.

7. The apparatus of claim 1 further comprising a center bore extending through the body, wherein the center bore is configured for holding additional cleaning pins.

* * * * *